US007553151B2

(12) United States Patent
O'Mara et al.

(10) Patent No.: US 7,553,151 B2
(45) Date of Patent: Jun. 30, 2009

(54) TIMER RELAY CONTROL BOARD

(75) Inventors: Jason O'Mara, Northville, MI (US); John James Schlachter, Leonard, MI (US)

(73) Assignee: Maxitrol Company, Southfield, MI (US)

( * ) Notice: Subject to any disclaimer, the term of this patent is extended or adjusted under 35 U.S.C. 154(b) by 59 days.

(21) Appl. No.: 11/461,586

(22) Filed: Aug. 1, 2006

(65) Prior Publication Data

US 2007/0204846 A1 Sep. 6, 2007

Related U.S. Application Data

(60) Provisional application No. 60/704,549, filed on Aug. 2, 2005.

(51) Int. Cl.
*F23N 5/00* (2006.01)

(52) U.S. Cl. ..... 431/62; 431/36; 431/37; 431/41; 126/116 A

(58) Field of Classification Search ..... 126/116 A; 431/36, 37, 41, 62; 110/101 C, 101 CF; 236/11, 46 E, 10, 1 E, 1 EA, 1 EB
See application file for complete search history.

(56) References Cited

U.S. PATENT DOCUMENTS

| | | | | | |
|---|---|---|---|---|---|
| 3,912,162 | A * | 10/1975 | Bauer et al. | ..... | 236/11 |
| 4,752,726 | A * | 6/1988 | Aoyama | ..... | 323/207 |
| 4,976,459 | A * | 12/1990 | Lynch | ..... | 236/11 |
| 5,027,789 | A * | 7/1991 | Lynch | ..... | 126/116 A |
| 5,326,025 | A * | 7/1994 | Dempsey et al. | ..... | 236/11 |
| 6,161,535 | A * | 12/2000 | Dempsey et al. | ..... | 126/110 R |
| 6,170,480 | B1 * | 1/2001 | Melink et al. | ..... | 126/299 R |
| 2004/0104276 | A1 * | 6/2004 | Weimer et al. | ..... | 236/10 |

* cited by examiner

*Primary Examiner*—Alfred Basichas
(74) *Attorney, Agent, or Firm*—Howard & Howard Attorneys PLLC

(57) ABSTRACT

A heater (12) includes a burner (16), a valve (20), and an inducer (18). A thermostat (24) is electrically coupled to the heater (12) and a control board (44) is disposed in the heater (12) and electrically connected to the thermostat (24). The control board (44) includes an inducer relay (50), a valve relay (52), and a control timer (54) for switching the valve (20) between a high flow stage and a low flow stage and the inducer (18) between a high speed stage and a low speed stage, respectively, wherein the inducer relay (50), the valve relay (52), and the control timer (54) are mounted to the control board (44) to define a singular and compact controller (30).

15 Claims, 4 Drawing Sheets

TIMER RELAY CONTROL BOARD

CROSS REFERENCE TO RELATED APPLICATION

This application claims the benefit of application Ser. No. 60/704,549 filed Aug. 2, 2005.

BACKGROUND OF THE INVENTION

1. Field of the Invention

The subject invention relates to a controller for a heater.

2. Description of the Prior Art

Various types of controllers for heaters are known in the art. These controllers include electromechanical components to control a valve and an inducer. Once such heater is shown in U.S. Pat. No. 5,326,025 (the '025 patent). The '025 patent discloses a controller electrically connected to an inducer relay that switches the inducer between a high speed stage and a low speed stage. In addition, the '025 patent discloses a controller that switches the valve between a high flow stage and a low flow stage.

Although the controllers of the prior art may be enjoyed by a wide variety of people, there remains an opportunity to improve upon the controllers of the prior art to define a singular and compact controller. Specifically, the controllers of the prior art require many wires, adding size and cost to the heater. Also, wiring the components adds time since each electrical component must be wired individually. Wiring each electrical component individually subsequently increases human error. Therefore, a controller for a heater is needed that reduces the size of the controller, the cost of the controller, the time to assemble the controller, and reduces human error when assembling the controller.

SUMMARY OF THE INVENTION AND ADVANTAGES

The invention provides a heater that includes a burner and a valve having a high flow stage and a low flow stage that is operatively connected to the burner for providing the burner with a fuel. An inducer having a high speed stage and a low speed stage is operatively connected to the burner for providing the burner with combustion air. A thermostat is electrically coupled to at least one of the valve and the inducer with the thermostat generating at least one signal for controlling at least one of the valve and the inducer. A control board is electrically connected between the thermostat and both of the valve and the inducer. The control board includes an input bus, an inducer relay for switching the inducer between the high speed stage and the low speed stage, a valve relay for switching the valve between the high flow stage and the low flow stage, a control timer for receiving the at least one signal from the thermostat and switching the valve between the high flow stage and the low flow stage and the inducer between the high speed stage and the low speed stage, respectively, in response to the at least one signal, and an output bus in communication with the valve and the inducer, wherein the input bus, the inducer relay, the valve relay, the control timer, and the output bus are mounted to the control board to define a singular and compact controller.

Additionally, the subject invention provides a controller for a heater. The heater includes an inducer and a valve. The controller includes an inducer relay for switching the inducer between a high speed stage and a low speed stage and a valve relay for switching the valve between a high flow stage and a low flow stage. A control timer is in communication with the inducer relay and the valve relay. An input bus is in communication with the inducer relay, the valve relay, and the control timer for providing the inducer relay with a start signal, the valve relay with a valve signal, and the control timer with a control signal. An output bus is in communication with the inducer relay and the valve relay. A control board supporting the inducer relay, the valve relay, the control timer, the input bus, and the output bus defines a singular and compact controller for simultaneously switching the inducer between the high speed stage and the low speed stage and the valve between the high flow stage and the low flow stage, respectively.

The subject invention provides a controller for a heater that has several advantages over the prior art. First, the controller of the subject invention may be produced at a smaller size and lower cost than the controllers of the subject invention. In addition, the controller of the subject invention may be produced more quickly with less chance of human error.

BRIEF DESCRIPTION OF THE DRAWINGS

Other advantages of the present invention will be readily appreciated, as the same becomes better understood by reference to the following detailed description when considered in connection with the accompanying drawings wherein.

DETAILED DESCRIPTION OF THE INVENTION

Figure 1:
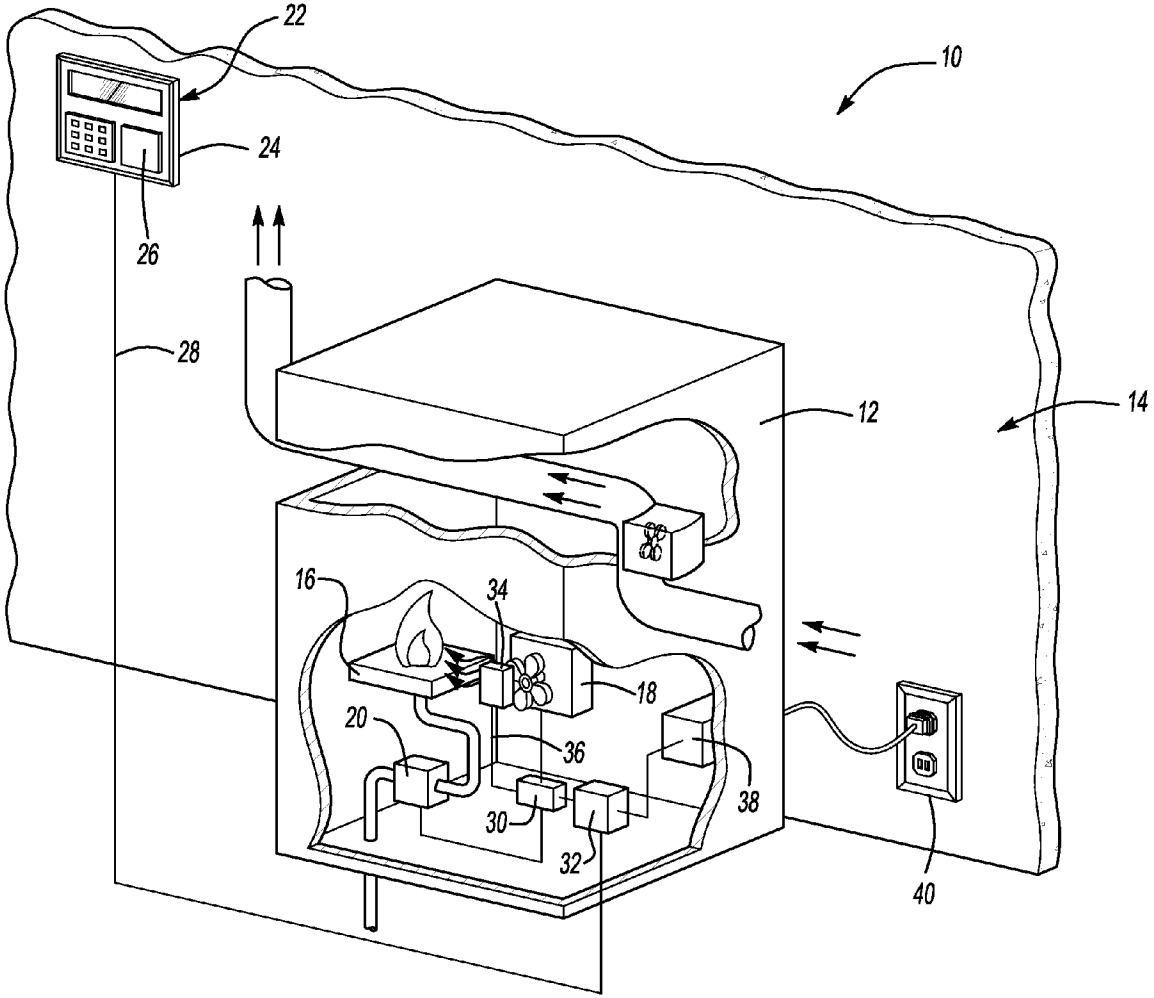
FIG. 1 is an isometric view of a heater assembled in accordance with the subject invention.
Figure 2:
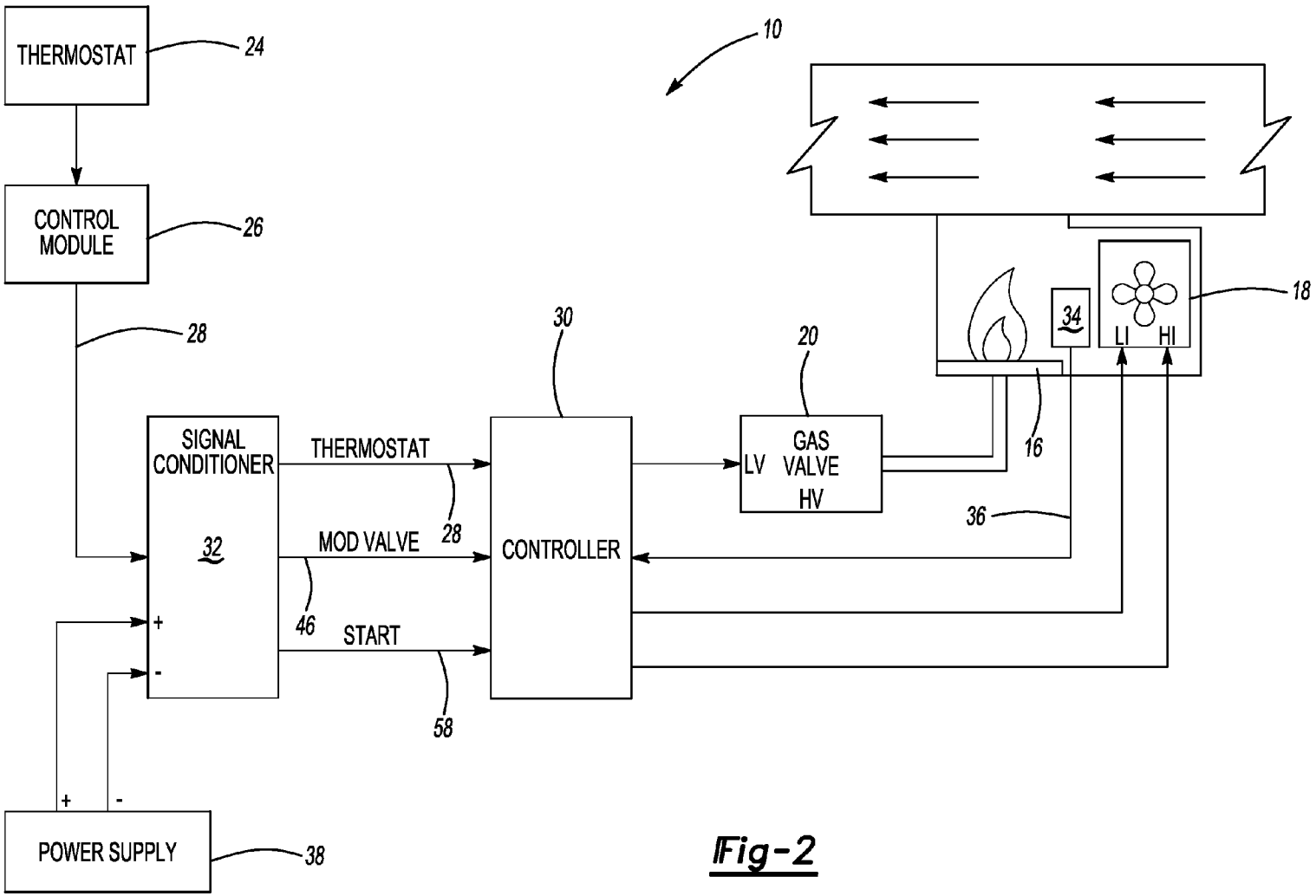
FIG. 2 is a schematic of a control system for the heater assembled in accordance with the subject invention.

Referring to the Figures, wherein like numerals indicate corresponding parts throughout the several views, a control system 10 for a heater 12 located in an environment 14, such as a furnace in a building, is shown generally in FIG. 1. Referring now to FIGS. 1 and 2, the heater 12 may include a burner 16. The heater 12 may also include an inducer 18 to provide the burner 16 with combustion air. The inducer 18 may be any type of inducer 18 known in the art having at least a high speed stage and a low speed stage. During the high speed stage, the inducer 18 provides the burner 16 with a greater amount of combustion air than during the low speed stage. The heater 12 may further include a valve 20 in fluid communication with the burner 16 to provide the burner 16 with a fuel, such as gas. The valve 20 is any type of valve known in the art and may operate under a high flow stage and a low flow stage. During the high flow stage, the valve 20 provides the burner 16 with a greater amount of air than during the low flow stage.

The heater 12 may be electrically connected to a sensor 22, such as a thermostat 24. The thermostat 24 measures a temperature of the environment 14 and may include a control module 26. The control module 26 may compare the temperature of the environment 14 to a minimum temperature, and generate a control signal 28 if the temperature of the environment 14 falls below the minimum temperature. Once the control signal 28 has been generated, the thermostat 24 may transmit the control signal 28 to a controller 30, which may be disposed within the heater 12. Additionally, a signal conditioner 32 may be disposed within the heater 12 and electrically connected to both the thermostat 24 and the controller 30. Furthermore, an air switch 34 may be disposed within the heater 12 for measuring the combustion air provided by the inducer 18. The air switch 34 may also be in communication with the controller 30 to control the gas valve 20 by enabling or disabling the high flow stage. Therefore, the air switch 34 provides the controller 30 with a high valve signal 36.

The controller 30 may be electrically connected to a power supply 38 that may provide the controller 30 with varying amounts of voltage. For instance, the power supply 38 may provide the signal conditioner 32 with 24 volts or 120 volts. In addition, the power supply 38 may provide the signal conditioner 32 with alternating current (AC) voltage or direct current (DC) voltage. As shown in FIG. 1, the power supply 38 may be plugged into an outlet 40, which may provide approximately 120 volts of AC voltage.

Figure 3:
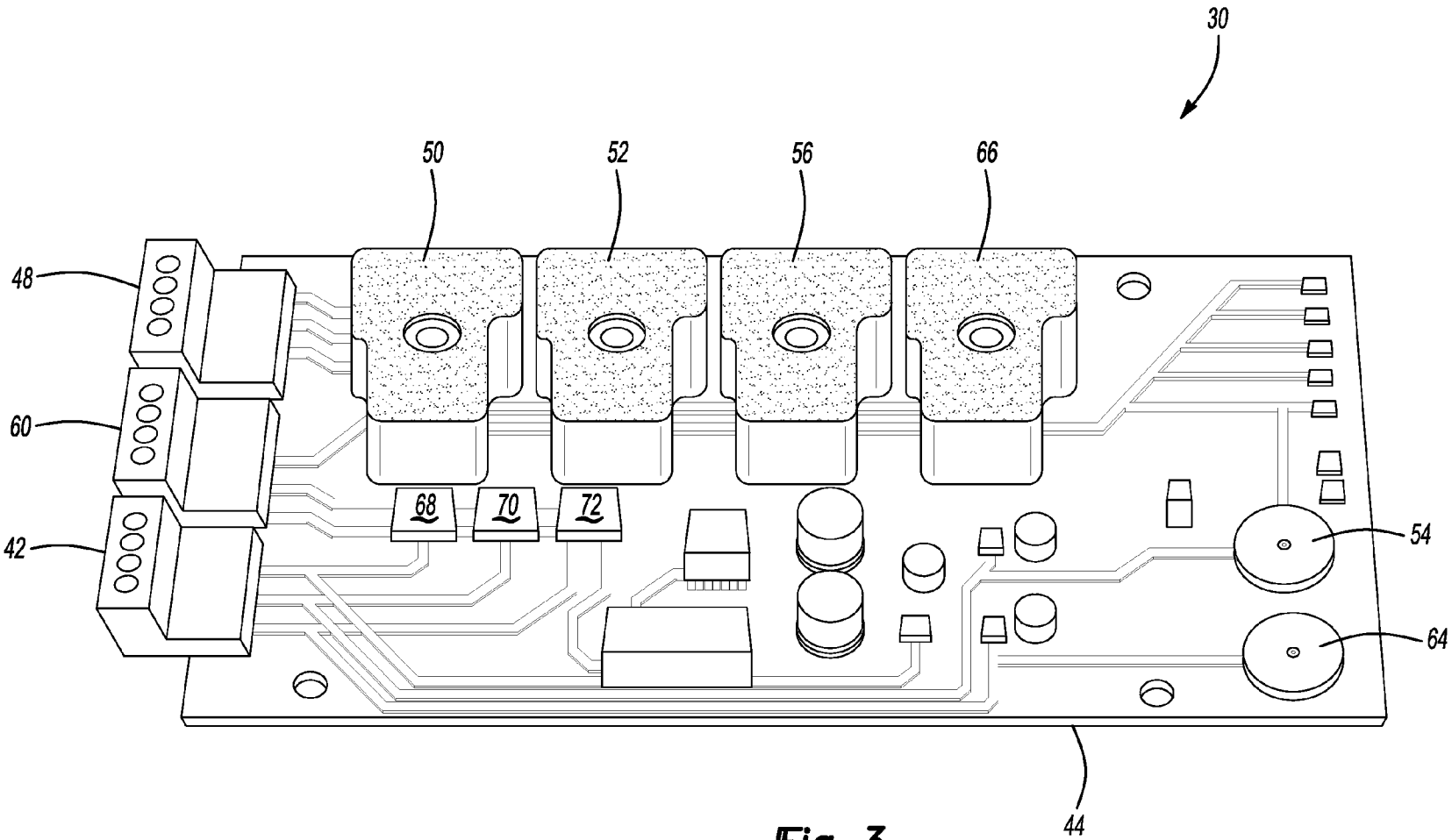
FIG. 3 is an isometric view of a controller for the heater assembled in accordance with the subject invention.
Figure 4:
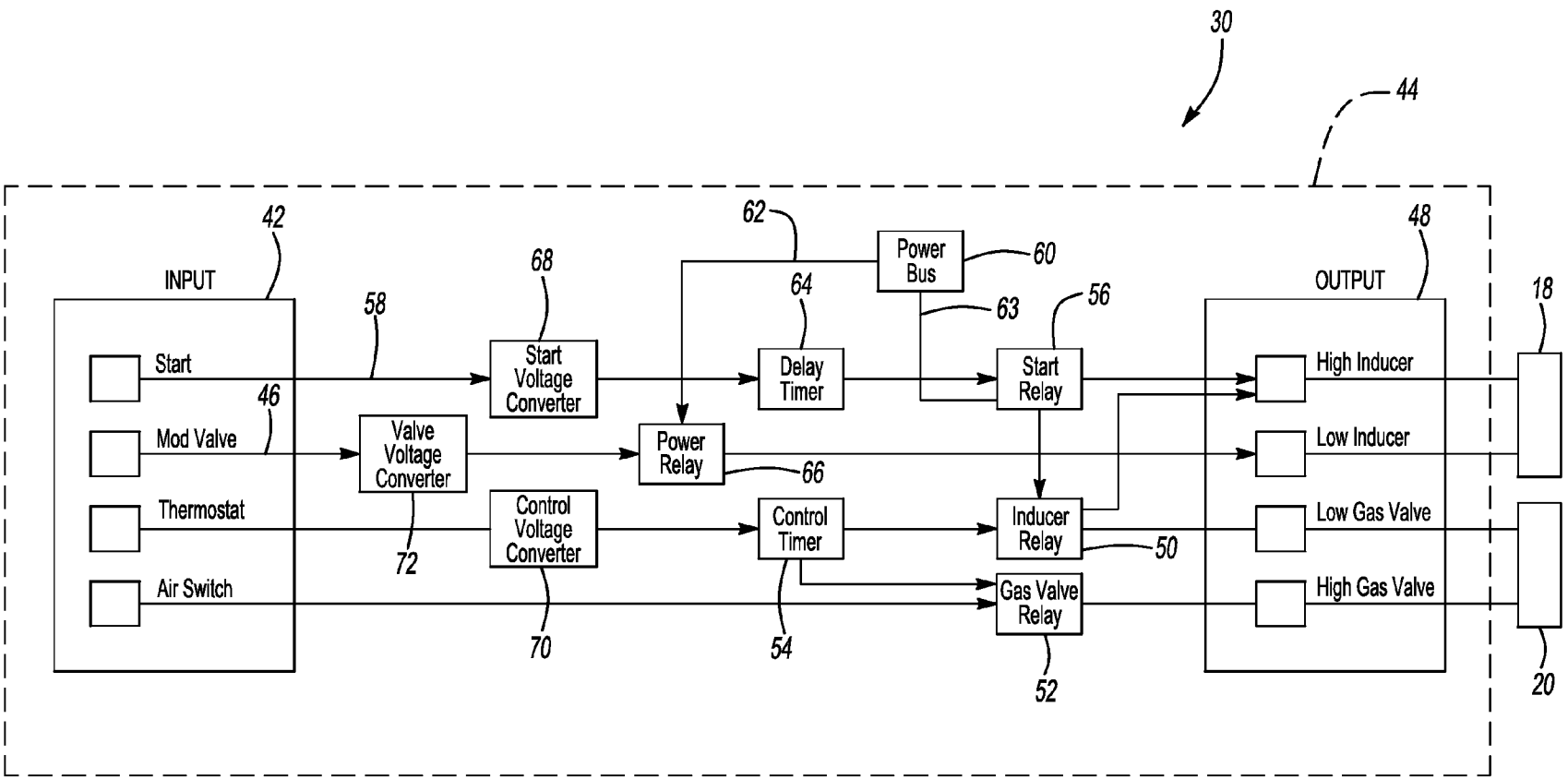
FIG. 4 is a schematic of the controller for the heater assembled in accordance with the subject invention.

Referring now to FIGS. 3 and 4, the controller 30 may include an input bus 42 mounted to a control board 44. The input bus 42 may receive the control signal 28 from the thermostat 24 and the high valve signal 36 from the air switch 34. In addition, the valve 20 may be in communication with the controller 30 to provide the input bus 42 with a valve signal 46. Furthermore, an output bus 48 may be mounted onto the control board 44. The output bus 48 may be in communication with the inducer relay 50, the valve relay 52, the inducer 18, and the valve 20 such that the output bus 48 provides an interface between the control board 44 and the inducer 18 and the valve 20.

The controller 30 may further include an inducer relay 50 mounted to the control board 44. The inducer relay 50 may be in communication with the input bus 42 and the output bus 48, and the inducer relay 50 may normally cause the inducer 18 to operate in the low speed stage. However, in response to the control signal 28, the inducer relay 50 may switch the inducer 18 to operate in the high speed stage. Alternatively, The inducer relay 50 may normally cause the inducer 18 to operate in the high speed stage and the control signal 28 may cause the inducer 18 to switch to the low speed stage.

In addition to the inducer relay 50, the controller 30 may further include a valve relay 52 mounted to the control board 44. The valve relay 52 may be in communication with the input bus 42 and the output bus 48, and may receive the high valve signal 36 from the air switch 34. In normal operation, the valve relay 52 may cause the valve 20 to operate in the low flow stage. However, in response to the high valve signal 36, the valve relay 52 may cause the valve 20 to switch from the low flow stage to the high flow stage. Alternatively, the valve 20 inducer 18 may normally cause the valve 20 to operate in the high flow stage and the high valve signal 36 may cause the valve 20 to switch to the low speed stage.

The inducer relay 50 and the valve relay 52 may also be in communication with a control timer 54. The control timer 54 may be mounted to the control board 44 between the thermostat 24 and both of the inducer relay 50 and the valve relay 52 to receive the control signal 28 before the inducer relay 50 and the valve relay 52. The control timer 54 holds the control signal 28 for a predetermined amount of time that defines a delay period. After the delay period has elapsed, the control timer 54 simultaneously passes the control signal 28 to the inducer relay 50 and the valve relay 52. The control signal 28 then triggers the inducer relay 50 and the valve relay 52 to switch stages. For instance, the control timer 54 triggers the inducer relay 50 to switch the inducer 18 from the high speed stage to the low speed stage. At the same time, the control timer 54 may trigger the valve relay 52 to switch the valve 20 from the high flow stage to the low flow stage. Likewise, the control timer 54 may trigger the inducer relay 50 to switch the inducer 18 from the low speed stage to the high speed stage and at the same time, trigger the valve relay 52 to switch the valve 20 from the low flow stage to the high flow stage. Those skilled in the art may appreciate that the control timer 54 may trigger the inducer relay 50 and the valve relay 52 to cause the inducer 18 and the valve 20, respectively, to operate in other combinations of stages.

When mounted onto the control board 44, the inducer relay 50, the valve relay 52, the control timer 54, the input bus 42, and the output bus 48 define a singular and compact controller 30 by eliminating aspects of the controllers 30 of the prior art that increase size and cost.

In addition to the inducer relay 50 and the valve relay 52, the controller 30 may further include a start relay 56 mounted to the control board 44 in communication with the input bus 42 and the output bus 48. The start relay 56 may receive a start signal 58 that triggers the start relay 56. Once triggered, the start relay 56 may initially enable the high speed stage of the inducer 18. Then, the inducer relay 50 may enable the inducer 18 to switch to the low speed stage. Those skilled in the art will appreciate that the start relay 56 may initially enable the low speed stage of the inducer 18, which allows the inducer relay 50 to switch the inducer 18 to the high speed stage. In addition to connecting to the inducer relay 50, the start relay 56 may also connect to a power bus 60, which may be electrically connected to the power supply 38. The power bus 60 may provide the start relay 56 with a power signal 63, which is a voltage, such as 120 volts AC, although those skilled in the art will appreciate that other voltages, including DC voltage and voltages of varying magnitudes, are within the scope of the subject invention.

In addition to the control timer 54, the controller 30 may further include a delay timer 64 mounted to the control board 44. The delay timer 64 may be in communication with the start relay 56 to hold the start signal 58 for a predetermined amount of time that defines a start delay period. After the start delay period has elapsed, the delay timer 64 may trigger the start relay 56 to enable the high speed stage of the inducer 18.

Furthermore, the controller 30 may include a power relay 66 that may be mounted to the control board 44 between the input bus 42 and the output bus 48. The power relay 66 may receive the power signal 62 from the power bus 60, which may be a different voltage than the power signal 63 received by the start relay 56. For instance, the power signal 62 may be 24 volts AC. Again, those skilled in the art will appreciate that other voltages, including DC voltage and voltages of varying magnitudes, are within the scope of the subject invention. In addition, the power relay 66 may receive the valve signal 46 from the input bus 42. The valve signal 46 may be generated by the valve 20 and transmitted to the controller 30 via the input bus 42. The valve signal 46 may trigger the power relay 66, causing the power relay 66 to output the power signal 62 to the output bus 48 to enable the gas valve 20 to operate in the low flow stage.

Next, the controller 30 may include at least one voltage converter mounted to the control board 44. Although those skilled in the art will appreciate that any number of voltage converters 68, 70, 72 may be used within the scope of the subject invention, the controller 30 may include a start voltage converter 68, a control voltage converter 70, and a power voltage converter 72. The start signal 58, the control signal 28, and the valve signal 46 may have a sinusoidal waveform, as is commonly characteristic of AC voltage. However, it may be necessary for the start signal 58, the control signal 28, and the valve signal 46 to have a continuous waveform, as is commonly characteristic of DC voltage. Therefore, the start voltage converter 68 may be mounted onto the control board 44 in communication with the input bus 42 and the delay timer 64 to receive the start signal 58 before the start signal 58 is transmitted to the delay timer 64, and the start voltage converter 68 may convert the start signal 58 from the sinusoidal waveform to the continuous waveform. Similarly, the controller 30 may include the control voltage converter 70 mounted to the control board 44 between the input bus 42 and the control timer 54. Like the start signal 58, the control voltage converter 70 may convert the control signal 28 from the sinusoidal waveform to the continuous waveform. In addition, the controller 30 may include a valve 20 voltage converter mounted to the control board 44 between the input bus 42 and the power relay 66. Like the start signal 58 and the control signal 28, the valve 20 voltage converter may convert the valve signal 46 from the sinusoidal waveform to the continuous waveform.

The invention has been described in an illustrative manner, and it is to be understood that the terminology which has been used is intended to be in the nature of words of description rather than of limitation. As is now apparent to those skilled in the art, many modifications and variations of the present invention are possible in light of the above teachings. It is, therefore, to be understood that within the scope of the appended claims, the invention may be practiced otherwise than as specifically described.

What is claimed is:

1. A heater comprising:

a burner;

a valve having a high flow stage and a low flow stage and operatively connected to said burner for providing said burner with a fuel;

an inducer having a high speed stage and a low speed stage and operatively connected to said burner for providing said burner with combustion air;

a thermostat electrically coupled to at least one of said valve and said inducer with said thermostat generating at least one signal for controlling at least one of said valve and said inducer; and a control board electrically connected between said thermostat and both of said valve and said inducer and including an input bus, an inducer relay for switching said inducer between said high speed stage and said low speed stage, a start relay in communication with said input bus for receiving a start signal from said input bus and activating said inducer relay in response to the start signal, a delay timer in communication with said start relay for activating said start relay with the start signal after a start delay period has elapsed, a valve relay for switching said valve between said high flow stage and said low flow stage, a control timer in communication with both said inducer relay and said valve relay for receiving the at least one signal from said thermostat and switching said valve between said high flow stage and said low flow stage and said inducer between said high speed stage and said low speed stage, respectively, in response to the at least one signal after a delay period has elapsed, and an output bus in communication with said valve and said inducer, wherein said input bus, said inducer relay, said valve relay, said control timer, and said output bus are mounted to said control board to define a singular and compact controller.

2. A heater as set forth in claim 1 further including a voltage converter mounted to said control board and in communication with said input bus and said delay timer for receiving the start signal and converting the start signal from a sinusoidal waveform to a continuous waveform.

3. A controller as set forth in claim 1 further including a power bus mounted to said control board in communication with said start relay for providing said start relay with a power signal.

4. A heater as set forth in claim 1 further including a voltage converter mounted to said control board and in communication with said input bus and said control timer for receiving the control signal and convening the control signal from a sinusoidal waveform to a continuous waveform.

5. A heater as set forth in claim 1 further including a power relay mounted to said control board and in communication with said input bus and said control timer for receiving a valve signal from said input bus and activating said valve in response to the valve signal.

6. A heater as set forth in claim 5 further including a voltage converter mounted to said control board and in communication with said input bus and said power relay for converting the valve signal from a sinusoidal waveform to a continuous waveform.

7. A controller as set forth in claim 5 further including a power bus mounted to said control board in communication with said power relay for providing said power relay with a power signal.

8. A heater as set forth in claim 1 further including an air switch in communication with said gas valve relay for measuring the combustion air provided by said inducer and providing said valve relay with a high valve signal.

9. A controller for a heater, the heater including an inducer and a valve, said controller comprising:

an inducer relay for switching the inducer between a high speed stage and a low speed stage;

a valve relay for switching the valve between a high flow stage and a low flow stage;

a control timer in communication with both said inducer relay and said valve relay for receiving the at least one signal from said thermostat and switching said valve between said high flow stage and said low flow stage and said inducer between said high speed stage and said low speed stage, respectively, in response to the at least one signal after a delay period has elapsed;

an input bus in communication with said inducer relay, said valve relay, and said control timer for providing said inducer relay with a start signal, said valve relay with a valve signal, and said control timer with a control signal;

a delay timer in communication with said input bus for receiving the start signal and providing a start delay period;

a start relay in communication with said delay timer and said inducer relay for receiving the start signal from said delay timer after the start delay period has elapsed and enabling said inducer relay in response to the start signal;

an output bus in communication with said inducer relay and said valve relay; and a control board supporting said inducer relay, said valve relay, said control timer, said start relay, said delay timer, said input bus, and said output bus to define a singular and compact controller for simultaneously switching the inducer between the high speed stage and the low speed stage and the valve between the high flow stage and the low flow stage, respectively.

10. A controller as set forth in claim 9 further including a voltage converter mounted to said control board and in communication with said input bus and said delay timer for converting the start signal from a sinusoidal waveform to a continuous waveform.

11. A controller as set forth in claim 9 further including a power bus mounted to said control board and in communication with said start relay for providing said start relay with a power signal.

12. A controller as set forth in claim 9 further including a voltage converter mounted to said control board and in communication with said input bus and said control timer for converting the control signal from a sinusoidal waveform to a continuous waveform.

13. A controller as set forth in claim 12 further including a voltage converter mounted to said control board and in communication with said input bus and said power relay for converting the valve signal from a sinusoidal waveform to a continuous waveform.

14. A controller as set forth in claim 12 further including a power bus mounted to said control board and in communication with said power relay for providing said power relay with a power signal.

15. A controller as set forth in claim 9 further including a power relay mounted to said control board and in communication with said input bus and said control timer for enabling said control timer.

* * * * *

UNITED STATES PATENT AND TRADEMARK OFFICE

CERTIFICATE OF CORRECTION

PATENT NO. : 7,553,151 B2
APPLICATION NO. : 11/461586
DATED : June 30, 2009
INVENTOR(S) : Jason O'Mara and John James Schlachter It is certified that error appears in the above-identified patent and that said Letters Patent is hereby corrected as shown below:

In Column 6, Line 10, Claim 4, delete "convening" and please replace with -- converting --.

Signed and Sealed this

First Day of September, 2009

David J. Kappos

David J. Kappos
*Director of the United States Patent and Trademark Office*